US007740384B2

(12) United States Patent
Steadman et al.

(10) Patent No.: US 7,740,384 B2
(45) Date of Patent: Jun. 22, 2010

(54) LIGHTING FIXTURE WITH ADJUSTABLE REFLECTOR

(75) Inventors: Connie A Steadman, Taylors, SC (US); Kevin W. Lawter, Chesnee, SC (US); Craig D. Wright, Moore, SC (US)

(73) Assignee: Hubbell Incorporated, Orange, CT (US)

( * ) Notice: Subject to any disclaimer, the term of this patent is extended or adjusted under 35 U.S.C. 154(b) by 291 days.

(21) Appl. No.: 11/896,483

(22) Filed: Aug. 31, 2007 (Under 37 CFR 1.47)

(65) Prior Publication Data

US 2008/0080195 A1 Apr. 3, 2008

Related U.S. Application Data

(60) Provisional application No. 60/843,710, filed on Sep. 12, 2006.

(51) Int. Cl.
*F21V 7/00* (2006.01)

(52) U.S. Cl. ..... 362/341; 362/364; 362/365; 362/368

(58) Field of Classification Search ..... 362/341, 362/364, 365, 368
See application file for complete search history.

(56) References Cited

U.S. PATENT DOCUMENTS 793,195 A 6/1905 Hubbell
1,077,384 A 11/1913 Aspinwall
1,602,222 A 10/1926 Godley
1,764,394 A 6/1930 Doane
4,764,855 A 8/1988 Fretz, III et al.
5,597,234 A 1/1997 Winkelhake
5,673,997 A 10/1997 Akiyama
6,350,047 B1 2/2002 Ng et al.
6,536,926 B2 3/2003 Bucher et al.

OTHER PUBLICATIONS

Calculite Compact Fluorescent Open Downlighting 8021: product information sheet of Lightolier (a Genlyte Company); 2006.
Calculite CFL Open Wall Washer 8021WW: product information sheet of Lightolier (a Genlyte Company); 2008.

*Primary Examiner*—Sandra L O'Shea
*Assistant Examiner*—Meghan K Dunwiddie
(74) *Attorney, Agent, or Firm*—Alfred N. Goodman; Mark S. Bicks; Jenae C. Gureff

(57) ABSTRACT

A lighting assembly comprising a socket member having a substantially tubular wall defining a cavity therein and a reflector having a first substantially tubular section telescopically received within the socket member side wall. The reflector includes first and second recesses in the first tubular section wherein the first recess is located at a first distance from an end of the first tubular section and the second recess is located at a second distance, greater than the first distance, from an end of the first tubular section. The lighting assembly includes a resilient or spring-biased member, such as a leaf spring, coupled to the socket member extending into the cavity wherein the socket member and reflector are adapted to be coupled together at first and second different positions with the first resilient member being receivable in the first recess in the first position and the first resilient member being receivable in the second recess in the second position.

36 Claims, 6 Drawing Sheets

LIGHTING FIXTURE WITH ADJUSTABLE REFLECTOR

CROSS-REFERENCE TO RELATED APPLICATIONS

This application claims the benefit of U.S. Provisional Application 60/843,710 filed Sep. 12, 2006, which application is hereby incorporated by reference in its entirety.

FIELD OF THE INVENTION

The present invention relates to a lighting assembly having a socket member and a reflector that are connected, disconnected, axially adjusted and rotationally adjusted by use of a pair of leaf springs on one member that are releasably engaged with a series of four recesses on the other member. The socket member and reflector are adapted to be coupled together at first and second axially spaced positions with a first leaf spring being receivable in a first recess in the first position and in a second recess in the second position. The first and second recesses are axially spaced and angularly spaced, which allows for rotational adjustment of the socket member and reflector. A second leaf spring and third and fourth recesses can also be used for greater connective strength.

BACKGROUND OF THE INVENTION

Conventional lighting assemblies having a socket and a reflector require the use of tools or more than one hand to connect, disconnect, adjust axially, and adjust rotatably. Connecting, disconnecting, and adjusting the socket and reflector can also present some difficulty, particularly when installing at an elevation where the installer must stand on a ladder.

Also, conventional lighting assemblies having a reflector received in a socket are not adjustable axially because there is only one connecting assembly for the reflector and socket. Manufacturing and tooling costs are also expensive for producing multiple reflectors, each having different lengths for inserting into sockets.

Other systems used generally as lighting assemblies with adjustable and detachable reflectors or shades connected to sockets with various mechanisms are disclosed in the following: U.S. Pat. No. 793,195 to Hubbell; U.S. Pat. No. 1,602,222 to Godley, U.S. Pat. No. 5,597,234 to Winkelhake; U.S. Pat. No. 6,350,047 to Ng et al.; and U.S. Pat. No. 6,536,926 to Bucher et al.

Accordingly, a need exists for a lighting assembly with an axially and rotatably adjustable reflector coupled to a socket with a simple connection mechanism.

SUMMARY OF THE INVENTION

Accordingly, an object of the invention is to provide a method of adjustably attaching a reflector to a socket member in a lighting assembly at one of a first or a second distance and at one of a first or second rotational position.

Another object of the invention is to provide a resilient member, such as a leaf spring, coupled to the socket member for securely connecting the socket member to the reflector at one of two or more distances and at one of two or more rotational positions.

A further object of the invention is to provide a tool-less method of connecting the reflector to the socket and adjusting the distance and angular positions therebetween.

Yet another object of the invention is to be able to rotate the reflector relative to the socket member until a locking member, such as a spring, is spaced axially on the reflector and aligns and engages with a locking member, such as a recess, on the reflector housing.

The foregoing objects are basically attained by providing a lighting assembly comprising a first member having a substantially tubular wall defining a cavity therein and a second member having a first substantially tubular section telescopically received within the first member side wall. The second member includes first and second recesses in the first tubular section wherein the first recess is located at a first distance from an end of the first tubular section and the second recess is located at a second distance, greater than the first distance, from an end of the first tubular section. Also, the lighting assembly includes a first resilient member coupled to the first member and extending into the cavity wherein the first member and second member are adapted to be coupled together at first and second different positions with the first resilient member being receivable in the first recess in the first position and the first resilient member being receivable in the second recess in the second position.

By forming a lighting assembly in this manner, a user can connect a first member, such as a socket member, and a second member, such as a reflector, without the use of tools or more than one hand. The reflector can be adjusted to different distances between the end of the reflector and the socket member and to different angular orientations such that different size bulbs and reflector surfaces can be accommodated. Moreover, the resilient member can be a leaf spring including first and second cam surfaces to move the leaf spring out of one recess and into another upon relative rotation of the socket member and reflector in first and second opposite rotational directions.

As used in this application, the terms "top", "bottom", and "side" are intended to facilitate the description of the lighting assembly, and are not intended to limit the description of the lighting assembly to any particular orientation.

Other objects, advantages, and salient features of the present invention will become apparent from the following detailed description, which, taken in conjunction with the annexed drawings, discloses preferred embodiments of the invention.

BRIEF DESCRIPTION OF THE DRAWINGS

Referring to the drawings which form a part of this disclosure.

Throughout the drawings, like reference numerals will be understood to refer to like parts, components, and structures.

DETAILED DESCRIPTION OF THE INVENTION

Figure 2:
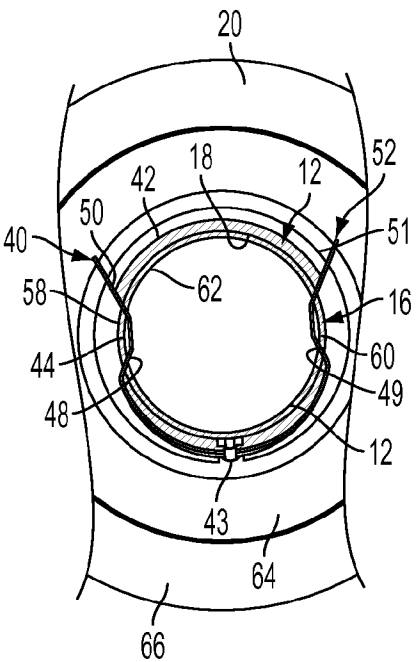
FIG. 2 is a top, elevational view in cross-section of the lighting assembly taken along line 2-2 in FIG. 1.
Figure 1:
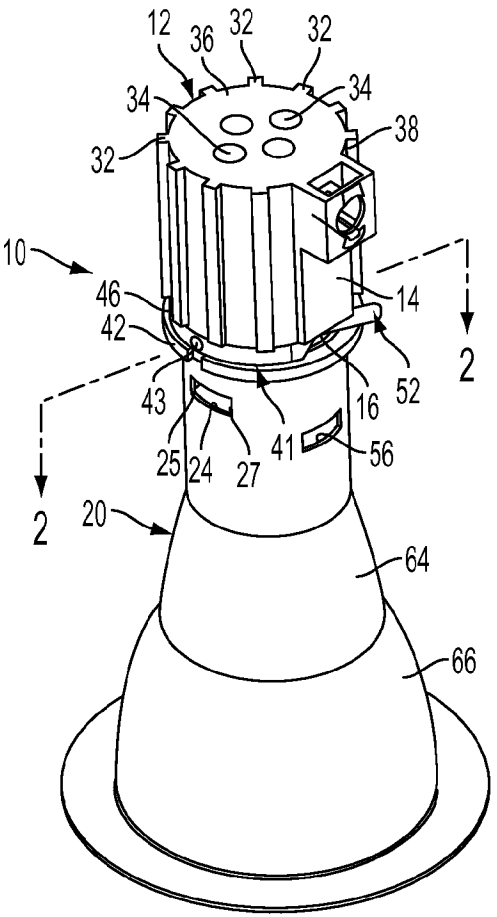
FIG. 1 is a perspective view of the lighting assembly according to an embodiment of the present invention with the socket member engaging the reflector.

As seen in FIGS. 1-12 the present invention relates to a lighting assembly 10 in which a socket member 12 and a reflector 20 can be connected, disconnected, axially adjusted, and rotationally adjusted by use of a pair of leaf springs 40 and 52, on one member that are releasably engaged with a series of recesses 24, 54, 30, and 56 on the other member. As seen in FIGS. 1-12, the leaf springs 40, 52 are coupled to the socket member 12 and the recesses 24, 54, 30, and 56 are located in the reflector 20; however, this construction can be reversed as desired.

Figure 3:
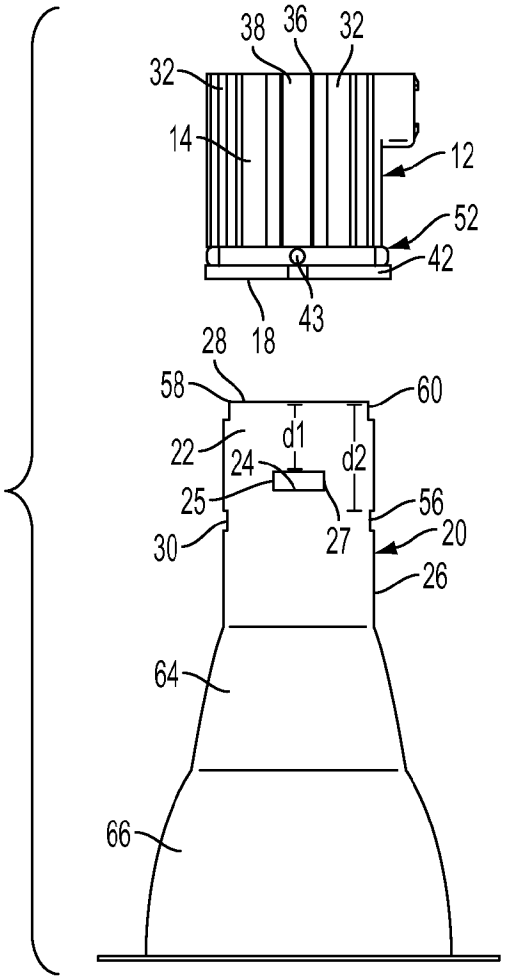
FIG. 3 is a front, exploded elevational view of the lighting assembly in FIG. 1 prior to assembly.

Turning to FIG. 3, the lighting assembly 10 includes the socket member 12 having a substantially tubular side wall 14 with a first aperture 16 therein, the reflector 20 having a first substantially tubular section 22 telescopically received within the socket member side wall 14, and a leaf spring 40 coupled to the socket member 12 and extending into the first aperture 16 wherein the socket member 12 and the reflector 20 are adapted to be coupled together at first and second different axial positions and four different rotational positions. The first leaf spring 40 is receivable in the first recess 24 in the first position and receivable in the second recess 30 in the second position.

The socket member 12 is substantially tubular in shape having an inner surface 18 defining an interior cavity 62 and an outer surface 38 defined by a substantially tubular side wall 14. The side wall 14 includes a plurality of radially directed projections 32 extending axially between the distal end 36 of the socket member 12 and the first aperture 16 at a bottom or proximal end 42 of the socket member 12. The projections 32 aid in providing optimum heat transfer between the interior of the lighting assembly 10 and the environment. The socket member 12 also includes a plurality of substantially circular openings 34 located towards the distal end 36 for receiving electrical wires and an electrical socket for connecting a power supply to a lamp received in the socket.

The proximal end 42 is a substantially circularly shaped opening. Between the distal end 36 and the proximal end 42, preferably closer to the proximal end 42, the tubular side wall 14 includes a first aperture 16 and a second aperture 44. First aperture 16 and second aperture 44 are substantially rectangularly shaped through openings spaced approximately 180° apart from each other. The first aperture 16 and second aperture 44 are located below a recessed ring 46 formed towards the proximal end 42. The recessed ring 46 extends around the entire circumference of the tubular side wall 14.

A piece of resilient material such as a metallic spring 41 is coupled to the socket member 12 and preferably attached via pin or rivet 43 halfway between first aperture 16 and second aperture 44 and disposed adjacent to the recessed ring 46 such that the non-cam surfaces of the spring 41 are substantially flush with the tubular side wall 14. The resilient material includes the first leaf spring 40 and a second leaf spring 52, advantageously integrally formed as one piece. The first leaf spring 40 extends into the first aperture 16 and includes first and second curved surfaces respectively forming a first cam surface 48 and a second cam surface 50 thereon, both normally located inside cavity 62 in the socket member. The second leaf spring 52 is coupled to the socket member 12 adjacent to the first leaf spring 40, extends into the second aperture 44, and includes first and second curved cam surfaces 49 and 51, both normally located inside cavity 62 in the socket member.

Figure 7:
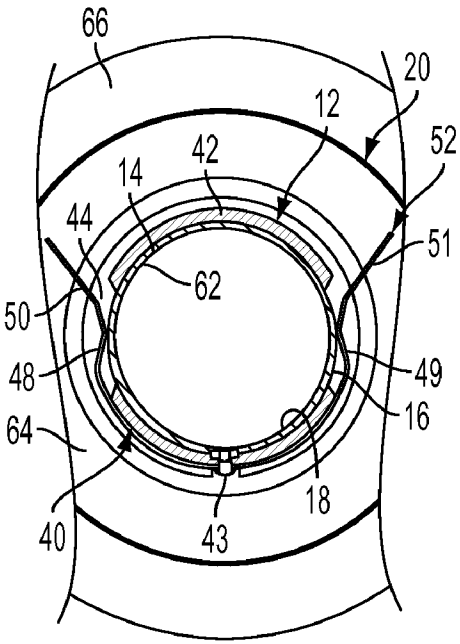
FIG. 7 is a top, elevational view in cross-section of the lighting assembly taken along line 7-7 in FIG. 6.
Figure 10:
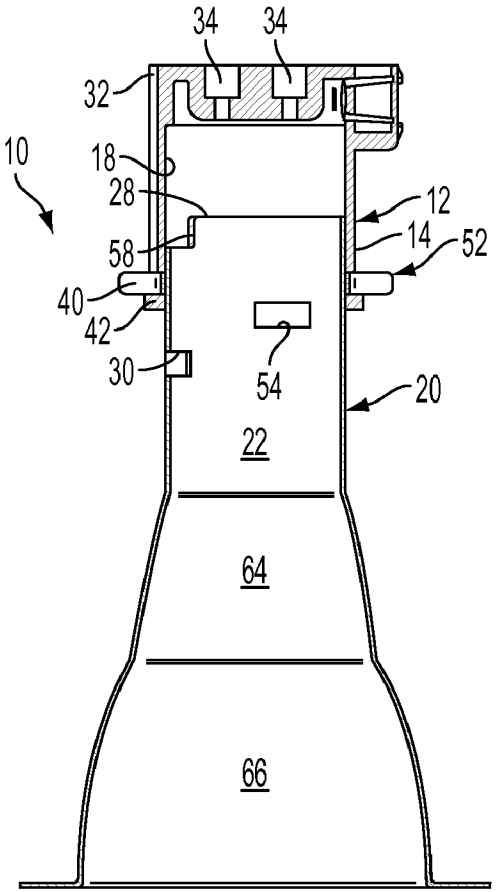
FIG. 10 is a side, elevational view in longitudinal cross-section of the lighting assembly in FIG. 9.
Figure 9:
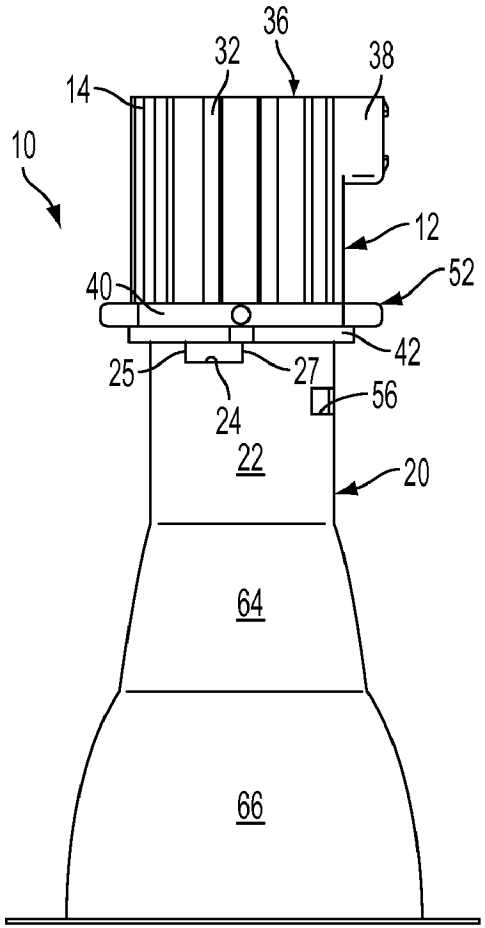
FIG. 9 is a front, elevational view of the lighting assembly as seen in FIGS. 6-8 with the spring forced open due to angular movement of the reflector to the right through about 90° relative to the socket member and the socket member progressing away from the open-ended slots by moving the reflector upwardly relative to the socket member so that the end of the socket member is just above one of the recesses.

The spring 41 has two positions, a rest position (FIG. 2) and an expanded position (FIG. 7). Turning to FIG. 2, when the spring is in a rest position, the cam surfaces of the springs 40, 52 are received in the first aperture and second aperture 16, 44, respectively. As seen in FIG. 7, when the cam surfaces 40, 52 are received in the apertures 16, 44, the surfaces 40, 52 extend into the inner surface cavity 62 of the socket member 12. When the spring is expanded, the cam surfaces 40, 52 are disposed slightly outside the first aperture 16 and second aperture 44 away from the interior cavity 62.

Rather than through apertures 16 and 44, blind recesses or cavities can be formed in the sidewall 14 of the socket member opening into the interior 62 of the socket member 12. In this case, the leaf springs 40 and 52 can be replaced by resilient spring-biased cams or resilient balls, although these alternative structures would likely be more expensive to make and assemble than the leaf springs 40 and 52.

The reflector 20 has a partial spherical member at one distal end for reflecting visible light beams from the lamp supported in the socket in the socket member 12. As seen in FIG. 3, the reflector 20 includes a first substantially tubular section 22 at its uppermost end 28. The reflector 20 includes a first recess 24 in the exterior surface 26 of the first tubular section 22 located at a first distance d1 from an end of the first tubular section 22. There is also a second recess 30 in the exterior surface 26 of the first tubular section 22 located at a second distance d2 from an end 28 of the first tubular section 22. The second distance d2 is greater than the first distance d1. A third recess 54 is disposed in the exterior surface 26 of the first tubular section 22 located at the same distance d1 from the end of the first tubular section 22 as the first recess 24. Similarly, a fourth recess 56 is disposed in the exterior surface 26 of the first tubular section 22 located at the same distance d2 from the end of the first tubular section 22 as the second recess 30. All of the recesses 24, 30, 54, 56 are substantially rectangularly shaped with first and second edges. Each has a height slightly greater than the height of the leaf springs 40, 52 so the leaf springs 40, 52 are receivable therein. Each recess 24, 30, 54, 56 has an angular extent of about 45° and, in the engaged position shown in FIG. 12, each recess receives the two cam surfaces on the leaf springs therein.

The first recess 24 and second recess 30 are spaced apart about 90° from one another. Likewise, the third recess 54 and fourth recess 56 are spaced apart about 90° from one another. Essentially, the first recess 24 and third recess 54 are spaced apart about 180° from one another, and the second recess 30 and fourth recess 56 are spaced apart about 180° from one another. Each of the recesses 24, 30, 54, 56 represents approximately 45° of the circular extent of the tubular section 22 such that a first recess is located between 0-45°, a second recess is located between 90°-135°, a third recess is located between 180°-225°, and a fourth recess is located between 270°-315°. Any of the recesses can represent the ranges described above so long as the first recess 24 and third recess 54, and the second recess 30 and fourth recess 56, are spaced apart by about 180° from one another, respectively. It is possible for the lighting assembly 10 to have more than one pair of recesses for receiving a leaf spring or similar apparatus.

In addition to the recesses, the reflector 20 also includes first open-ended slot 58 and second open-ended slot 60 in an end 28 of the reflector 20 adapted to receive a leaf spring therein upon initial telescoping of the reflector 20 into the socket member 22. The slots 58, 60 are substantially U-shaped and spaced apart about 180° from one another.

Downward from the tubular section 22, the reflector 20 includes a middle section 64 outwardly angled to increase the reflective surface. The middle section 64 is adjacent on its outermost end to an exterior section 66. The exterior section 66 has the greatest surface area and widest curve extending towards the end of the reflector 20.

Operation

Figure 4:
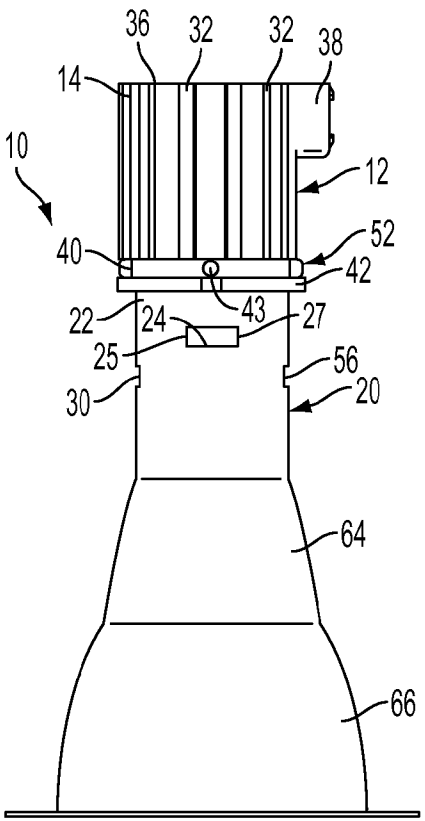
FIG. 4 is a front, elevational view of the lighting assembly as seen in FIGS. 1 and 2 with the spring in the socket member engaging the open-ended slot in an end of the reflector.
Figure 5:
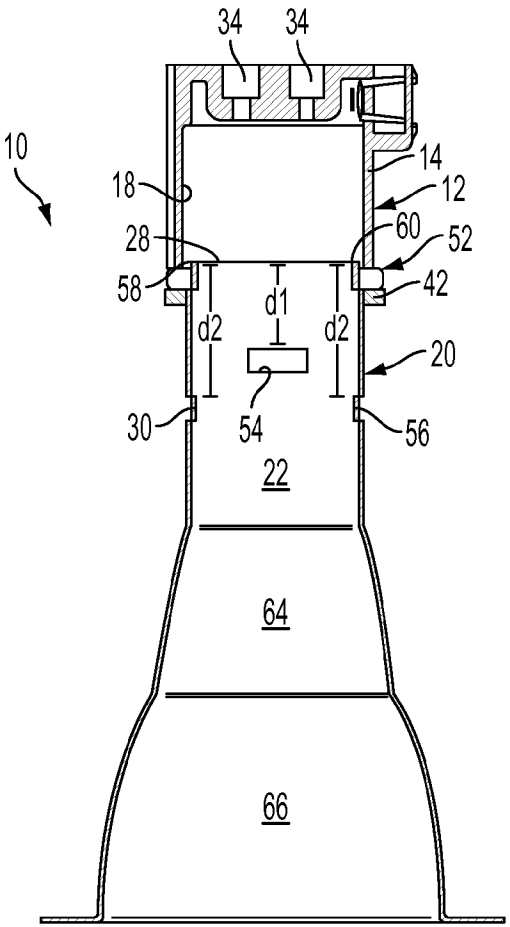
FIG. 5 is a side, elevational view in longitudinal cross-section of the lighting assembly shown in FIG. 4.

Turning to FIGS. 3-12, the progression of connecting the socket member 12 to the reflector 20 to form the lighting assembly 10 at different distances and angular orientations is illustrated in sequence. As seen in FIG. 3, the socket member 12 is aligned with the reflector 20 such that the leaf spring 41 is in a rest position. Turning to FIGS. 4 and 5, the end 28 of the reflector 20 is inserted into the bottom 42 of the socket member 12 and the cam surfaces 48, 50 and 49 and 51 are received in the open ended slots 58, 60. Illustrated in FIG. 2, cam surfaces 48 and 50 are received in first slot 58 and cam surfaces 49 and 51 are received in second slot 60.

Figure 6:
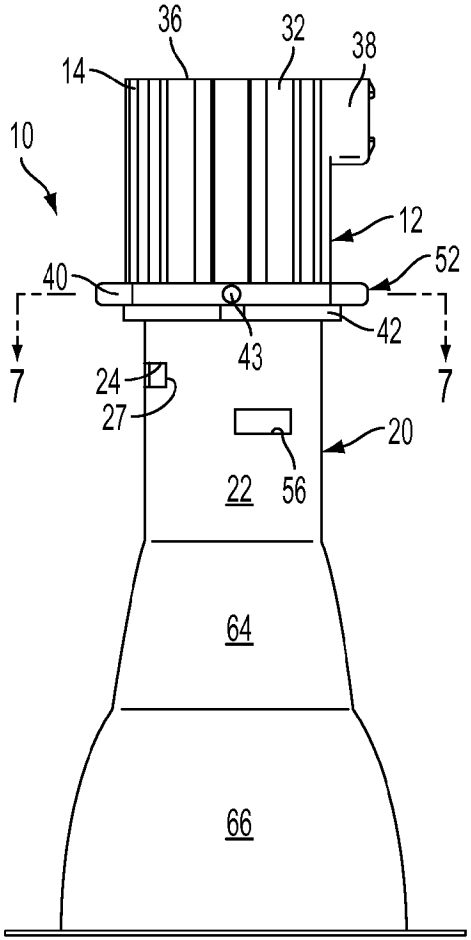
FIG. 6 is a front elevational view of the lighting assembly as seen in FIG. 5 but with the leaf spring forced open onto the outer surface of the reflector via rotation of the reflector to the left as compared to FIG. 5.
Figure 8:
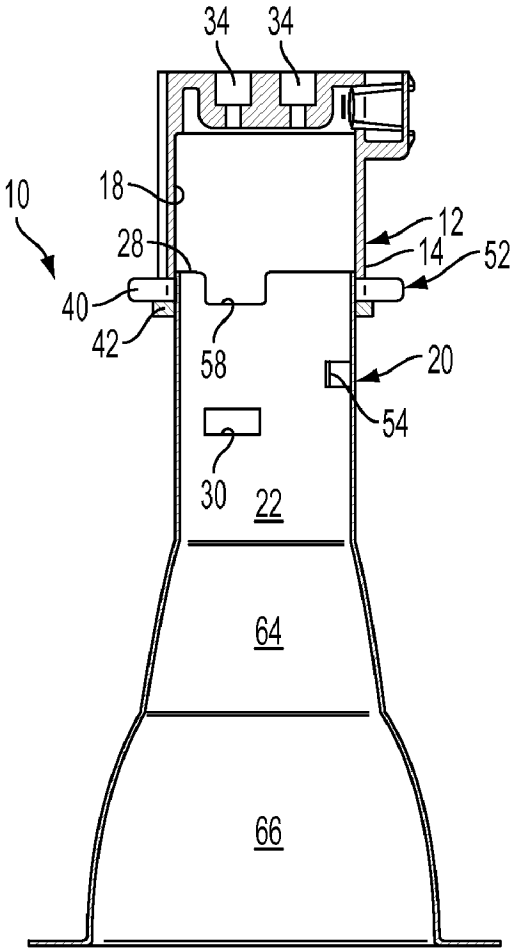
FIG. 8 is a side, elevational view in longitudinal cross-section of the lighting assembly shown in FIGS. 6 and 7.

Turning to FIGS. 6-8, the reflector 20 is rotated from a rest position of the leaf spring 41 to an expanded position in which the cam surfaces engage the edges of the slots and cam the leaf springs inwardly onto the outer surface of the tubular section 22.

Further, the reflector 20 is rotated axially and rotationally with respect to the socket member 12 until the cam surfaces 48, 49, 50, 51 are received by a pair of recesses, specifically received at first edge 25 and second edge 27. If the appropriate distance between the socket member 12 and the reflector 20 should be d1, then the reflector 20 is rotated with respect to the socket member 12 until the first recess 24 and third recess 54 are aligned with the apertures 16, 44. At this orientation, the cam surfaces 48, 49, 50, 51 are received by apertures 16, 44.

Next the reflector 20 can be rotated and moved axially relative to the socket member 12 until a first or second locking member spaced axially on the reflector and a third locking member on the socket member 12 align and engage. The first and second locking members are recesses formed on the exterior surface of the reflector 20, and the third locking member is the leaf spring received in a socket member 20 aperture. Specifically, the first leaf spring 40 is receivable in the first or second recesses 24, 30 when the second leaf spring 52 is receivable in the third or fourth recesses 54, 56. Alternatively, the second leaf spring 52 is received in the first or second recesses 24, 30 when the first leaf spring 40 is received in the third or fourth recesses 54, 56.

The socket member 12 is securely attached to the reflector 20 if the socket member 12 is rotated and engages diametrically opposed recesses: first recess 24 and third recess 54 or second recess 30 and fourth recess 56. Upon relative rotation of the socket member 12 and reflector 20 in a first rotational direction, the force of the tubular section 22 against the first cam surface 48 allows the first leaf spring 40 to move out of the first recess 24 and the second leaf spring 52 to move out of the third recess 54. Upon relative rotation of the socket member 12 and reflector in a second rotational direction opposite the first rotational direction, the force of the tubular section 22 against the second cam surface 50 allows the first leaf spring 40 to move out of the third recess 54 and the second leaf spring 52 to move out of the fourth recess 56. The cam surfaces 48, 50 and 49, 51 are expanded until they engage another pair of recesses and assume a rest position by protruding into the interior cavity 62.

Figure 12:
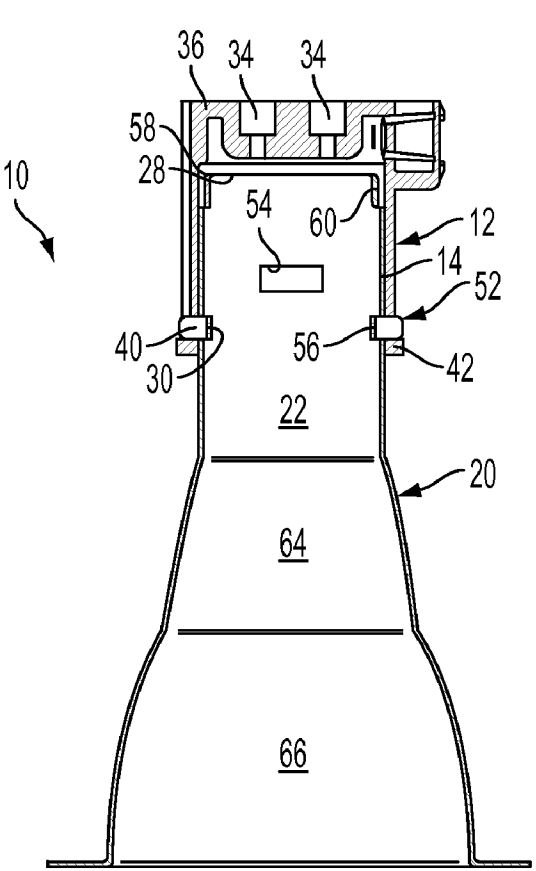
FIG. 12 is a side, elevational view in longitudinal cross-section of the lighting assembly in FIG. 11.
Figure 11:
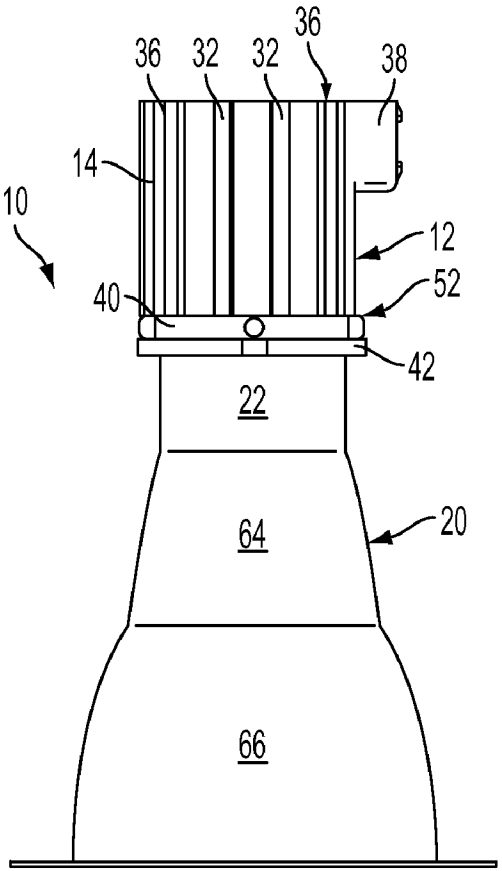
FIG. 11 is a front elevational view of the lighting assembly as seen in FIG. 10 but with the socket member and reflector moved relative to one another so that the leaf springs are axially aligned with the two lowermost recesses and the socket member and reflector rotated relative to one another so that the leaf springs are fully received in the two lowermost recesses.

Moreover, to engage the next pair of recesses, the reflector 20 is again rotated from a rest position to an expanded position and inserted further into the socket 12 until additional locking members on the reflector 20 engage the leaf spring 40. In this manner, the first cam surface 48 and the second cam surface 50 disengage from first recess 24 and third recess 54 and slide across the tubular section 22 until they engage the second recess 30 and fourth recess 56 as seen in FIGS. 11 and 12.

It is possible to engage the lowermost pair of recesses 30, 56 without ever having engaged the uppermost pair of recesses 24, 54. Also, once the socket member 12 and reflector 20 are connected, the spring can engage a pair of recesses by first rotating the socket member 12 with respect to the reflector 20 and then telescopically advancing the reflector 20 into the socket member 12 until the cam surfaces align with the recesses. Alternatively, the spring can engage a pair of recesses by first telescopically advancing the reflector 20 into the socket member 12 and then rotating the socket member 12 with respect to the reflector 20 until the cam surfaces align with the recesses.

The steps are reversed to disconnect the reflector 20 from the socket member 12 by rotating the reflector 20 relative to the socket member 12 until the first or second locking members on the reflector 20 disengage the third locking member on the socket member 20. The reflector 20 is then raised relative to the socket member 12 until the first or second locking member is spaced axially on the reflector 20 and the third locking member do not align. Finally, the end of the reflector 20 is removed from the socket member 12.

In additional embodiments, the lighting assembly 10 may include one recess in the exterior surface of the reflector 20 and one leaf spring having one leaf spring and coupled to the socket member 12. The first cam surface would be adapted to move the spring out of the first recess upon relative rotation of the reflector 20 and socket member 12 in a first directional rotation. The reflector 20 would also include one open-ended slot formed along its end to receive the leaf spring upon initial telescoping of the reflector 20 into the socket 12. Upon relative rotation of the reflector 20 and socket member 12 in a first directional rotational direction, the first cam surface would engage an edge of the slot and move to an outer surface of the reflector. With this configuration, further movement would allow the first leaf spring to move into the first recess. Optionally, the leaf spring could include a second cam surface in a direction opposite that of the first cam surface.

In another embodiment, one of the socket member or the reflector includes a first recess having a first edge 25 and an opposing second edge 27. The other includes a leaf spring extending into the first recess and having first and second cam surfaces. The first cam surface moves the leaf spring out of the first recess upon relative rotation of the socket member and reflector in a first rotational direction by the first cam surface engaging the first edge 25. The second cam surface moves the leaf spring out of the first recess upon relative rotation of the socket member and reflector in a second rotational direction opposite the first rotational direction by the second cam surface engaging the second edge 27. In this manner, the reflector and socket member are adapted to be coupled together at a first position with the first leaf spring being receivable in the first recess the first position. The lighting assembly 10 could also include a second recess located at a second distance from an end of the member that also includes the first recess located at a first distance and is adapted to receive the first leaf spring therein to connect the socket member and reflector.

While a particular embodiment has been chosen to illustrate the invention, it will be understood by those skilled in the art that various changes and modifications can be made therein without departing from the scope of the invention as defined in the appended claims.

What is claimed is:

1. A lighting assembly including first and second members, one of the members being a socket member and the other of the members being a reflector, the combination comprising:

a first member having a substantially tubular side wall defining a cavity therein;

a second member having a first substantially tubular section telescopically received within said first member tubular side wall and including a first recess in the exterior surface of said first tubular section located at a first distance from an end of said first tubular section, and a second recess in the exterior surface of said first tubular section located at a second distance, greater than said first distance, from an end of said first tubular section; and a first resilient member coupled to said tubular side wall of said first member and extending into said cavity, wherein said first member and said second member are adapted to be coupled together at first and second different positions with said first resilient member being receivable in said first recess in said first position and said first resilient member being receivable in said second recess in said second position.

2. A lighting assembly according to claim 1, wherein said first resilient member comprises a first leaf spring.

3. A lighting assembly according to claim 1, wherein said first resilient member has a first cam surface thereon to move said first resilient member out of said first recess upon relative rotation of said first and second members in a first rotational direction.

4. A lighting assembly according to claim 3, wherein said first resilient member has a second cam surface thereon to move said first resilient member out of said first recess upon relative rotation of said first and second members in a second rotational direction opposite said first rotational direction.

5. A lighting assembly according to claim 1, and further comprising a second resilient member coupled to said tubular side wall of said first member and extending into said cavity, said second resilient member being receivable in said first or second recesses.

6. A lighting assembly according to claim 5, wherein said first resilient member and said second resilient member are integrally formed as one piece of resilient material.

7. A lighting assembly according to claim 5, and further comprising a third recess in the exterior surface of said first tubular section located at said first distance from the end of said first tubular section, a fourth recess in the exterior surface of said first tubular section located at said second distance from the end of said first tubular section, said first resilient member being receivable in said first or second recess and said second resilient member being receivable in said third or fourth recess, respectively.

8. A lighting assembly according to claim 5, wherein said first and second resilient members extend into said cavity at locations that are spaced about 180° from one another.

9. A lighting assembly according to claim 1, wherein said first and second recesses are spaced apart about 90° from one another.

10. A lighting assembly according to claim 7, wherein said third and fourth recesses are spaced about 90° from one another.

11. A lighting assembly according to claim 10, wherein said first and third recesses are spaced apart about 180° from one another, and said second and fourth recesses are spaced about 180° from one another.

12. A lighting assembly according to claim 1, and further comprising a first open-ended slot formed in an end of said second member adapted to receive said first resilient member therein upon initial telescoping of said second member into said first member.

13. A lighting assembly according to claim 12, and further comprising a second open-ended slot formed in an end of said second member adapted to receive said first resilient member therein upon initial telescoping of said second member into said first member.

14. A lighting assembly including first and second members, one of the members being a socket member and the other of the members being a reflector, the combination comprising:

a first member having a substantially tubular side wall defining a cavity therein;

a second member having a first substantially tubular section telescopically received within said first member tubular side wall and including a first recess in the exterior surface of said first tubular section located at a first distance from an end of said first tubular section;

a first resilient member coupled to said first member and extending into said cavity and having a first cam surface thereon, wherein said first member and said second member are adapted to be coupled together at a first position with said first resilient member being receivable in said first recess in said first position, said first cam surface adapted to move said first resilient member out of said first recess upon relative rotation of said first and second members in a first rotational direction; and a first open-ended slot formed in an end of said second member adapted to receive said first resilient member upon initial telescoping of said second member into said first member, wherein upon relative rotation of said first and second members in a first rotational direction said first cam surface engages an edge of said slot and moves to an outer surface of said second member, whereby further movement allows said first resilient member to move into said first recess.

15. A lighting assembly according to claim 14, and further comprising a second cam surface located on said first resilient member facing in a direction opposite to said first cam surface.

16. A lighting assembly including first and second members, one of the members being a socket member and the other of the members being a reflector, the combination comprising:

a first member having a substantially tubular side wall defining a cavity therein;

a second member having a first substantially tubular section telescopically received within said first member tubular side wall;

a first recess in the exterior surface of one of said first member and said second member located at a first distance from an end of said member having first and second opposed edges; and a first resilient member coupled to the other of said first member and said second member and extending into said cavity and having a first cam surface thereon to move said first resilient member out of said first recess upon relative rotation of said first and second members in a first rotational direction by said first cam surface engaging said first edge, and a second cam surface thereon to move said first resilient member out of said recess upon relative rotation of said first and second members in a second rotational direction opposite said first rotational direction by said second cam surface engaging said second edge, wherein said first member and said second member are adapted to be coupled together at a first position with said first resilient member being receivable in said first recess in said first position.

17. A lighting assembly according to claim 16, and further comprising a second recess in the exterior surface of one of said first and second members located at a second distance from an end of said member and adapted to receive said first resilient member therein to couple said first and second members together.

18. A lighting assembly including first and second members, one of the members being a socket member and the other of the members being a reflector, the combination comprising:

a first member having a substantially tubular side wall with first and second apertures formed therein;

a second member having a first substantially tubular section telescopically received within said first member tubular sidewall and including first and second recesses in an exterior surface of said first tubular section at substantially the same first distance from an end of said first tubular section, and third and fourth recesses disposed on an exterior surface of said first tubular section at substantially the same second distance from an end of said first tubular section; and a first leaf spring coupled to said first member and extending into said first aperture, and a second leaf spring coupled to said first member and extending into said second aperture, wherein said first and second members are adapted to be coupled together at two different axial positions and four different rotational positions with said first leaf spring being receivable in said first or third recesses and with said second leaf spring being receivable in said second and fourth recesses.

19. A method of attaching a first member to a second member in a lighting assembly comprising the steps of inserting an end of the first member into the second member, rotating the first member relative to the second member until a first or second locking member spaced axially on the first member and a third locking member located on the second member align, and inserting the end of the first member further into the second member until the first or second locking members on the first member engage the third locking member on the second member.

20. A method of attaching according to claim 19, wherein the first and second locking members comprise recesses formed on the exterior surface of the first member.

21. A method of attaching according to claim 19, wherein the third locking member comprises a leaf spring received in an aperture in the second member.

22. A method of attaching according to claim 19, wherein the third locking member comprises a spring-biased member coupled to the second member.

23. A method of attaching according to claim 21, wherein the first inserting step comprises inserting the leaf spring in an open-ended slot in the end of the first member and rotating the first member relative to the second member.

24. A method of attaching a first member to a second member in a lighting assembly comprising the steps of inserting an end of the first member into the second member, inserting a leaf spring in an open-ended slot in the end of the first member and rotating the first member relative to the second member, inserting the end of the first member further into the second member until a first or second locking member spaced axially on the first reflector and a third locking member located on the socket align axially, and rotating the first member relative to the second member until the first or second locking members on the first member engage the third locking member on the second member.

25. A method of attaching according to claim 24, wherein the first and second locking members comprise recesses formed on the exterior surface of the first member.

26. A method of attaching according to claim 24, wherein the third locking member comprises a leaf spring received in an aperture in the second member.

27. A method of attaching according to claim 24, wherein the third locking member comprises a spring-biased member coupled to the second member.

28. A method of attaching according to claim 26, wherein the first inserting step comprises inserting the leaf spring in an open-ended slot in the end of the first member and rotating the first member relative to the second member.

29. A method of disconnecting a first member from a second member in a lighting assembly comprising the steps of rotating an end of the first member relative to the second member until a first or second locking member spaced axially on the first member disengages from a third locking member located on the second member, and moving the first member relative to the second member until the first member is removed from the second member.

30. A lighting assembly according to claim 1, wherein said tubular side wall of said first member and said tubular section of said second member telescope in an axial direction, and said first resilient member is elongated and extends in its elongated direction transversely of said axial direction.

31. A lighting assembly according to claim 30, wherein said first resilient member has a first cam surface thereon to move said first resilient member out of said first recess upon relative rotation of said first and second members in a first rotational direction.

32. A lighting assembly according to claim 31, wherein said first resilient member has a second cam surface thereon to move said first resilient member out of said first recess upon relative rotation of said first and second members in a second rotational direction opposite said first rotational direction.

33. A lighting assembly according to claim 30, and further comprising a second elongated resilient member coupled to said tubular side wall, extending into said cavity and extending in its elongated direction transversely of said axial direction, said second resilient member being receivable in said first or second recesses.

34. A lighting assembly according to claim 33, wherein said first resilient member and said second resilient member are integrally formed as one piece of resilient material.

35. A lighting assembly according to claim 1, wherein said first resilient member extends into said first member tubular side wall.

36. A lighting assembly according to claim 35, wherein said first resilient member extends through an aperture in said first member tubular side wall.

* * * * *